United States Patent [19]

Dagonnet et al.

[11] 4,081,105

[45] Mar. 28, 1978

[54] PEDAL BIN

[75] Inventors: Daniel Dagonnet, Amiens; Gérard Chalmé, Bihorel-les Rouen, both of France

[73] Assignee: Societe Industrielle et Commerciale de Transformation des Plastiques "Sicopal", Douai, France

[21] Appl. No.: 779,148

[22] Filed: Mar. 18, 1977

[51] Int. Cl.[2] ..... B65D 43/26

[52] U.S. Cl. ..... 220/263; 220/409; 220/1 T

[58] Field of Search ..... 220/1 T, 17, 262–264

[56] References Cited

U.S. PATENT DOCUMENTS

| | | | |
|---|---|---|---|
| 1,820,555 | 8/1931 | Buschman | 220/263 |
| 2,910,206 | 10/1959 | Hodgson | 220/263 |

*Primary Examiner*—George T. Hall

*Attorney, Agent, or Firm*—Gary E. Lande

[57] ABSTRACT

The present invention relates to a novel pedal bin comprising a receptacle forming the actual bin, a jacket adapted to slide along the receptacle, the relative movement of the jacket with respect to the receptacle being controlled by a pedal, a lid hinged to said jacket, and possibly means for returning said lid into closed position after the bin has been opened.

2 Claims, 2 Drawing Figures

PEDAL BIN

The present invention relates to a novel pedal bin.

Various pedal bins are already known whose lid may be opened or closed as desired without having to use the hands, by means of any mechanical device actuated by the foot.

Pedal bins in which the mechanical device is made of metal generally do not pose problems as regards their instantaneous functioning, but to ensure that they work well over a prolonged period in the most diverse atmospheres, particular precautions must be taken, which may be expensive.

Pedal bins in which the mechanical device is made entirely of plastics material may on the other hand function with difficulty due to the parts controlling the opening of the lid being insufficiently rigid.

It is an object of the present invention to overcome the abovementioned difficulties.

To this end, the invention relates to a novel pedal bin comprising:

a removable receptacle forming the actual bin, a jacket adapted to slide along said receptacle, the relative movement of the jacket with respect to the receptacle being controlled by a pedal, a lid hinged to said jacket, and possibly means for returning the lid into closed position after the bin has been opened.

The invention will be more readily understood on reading the following description with reference to the accompanying drawings, in which.

Figure 1:
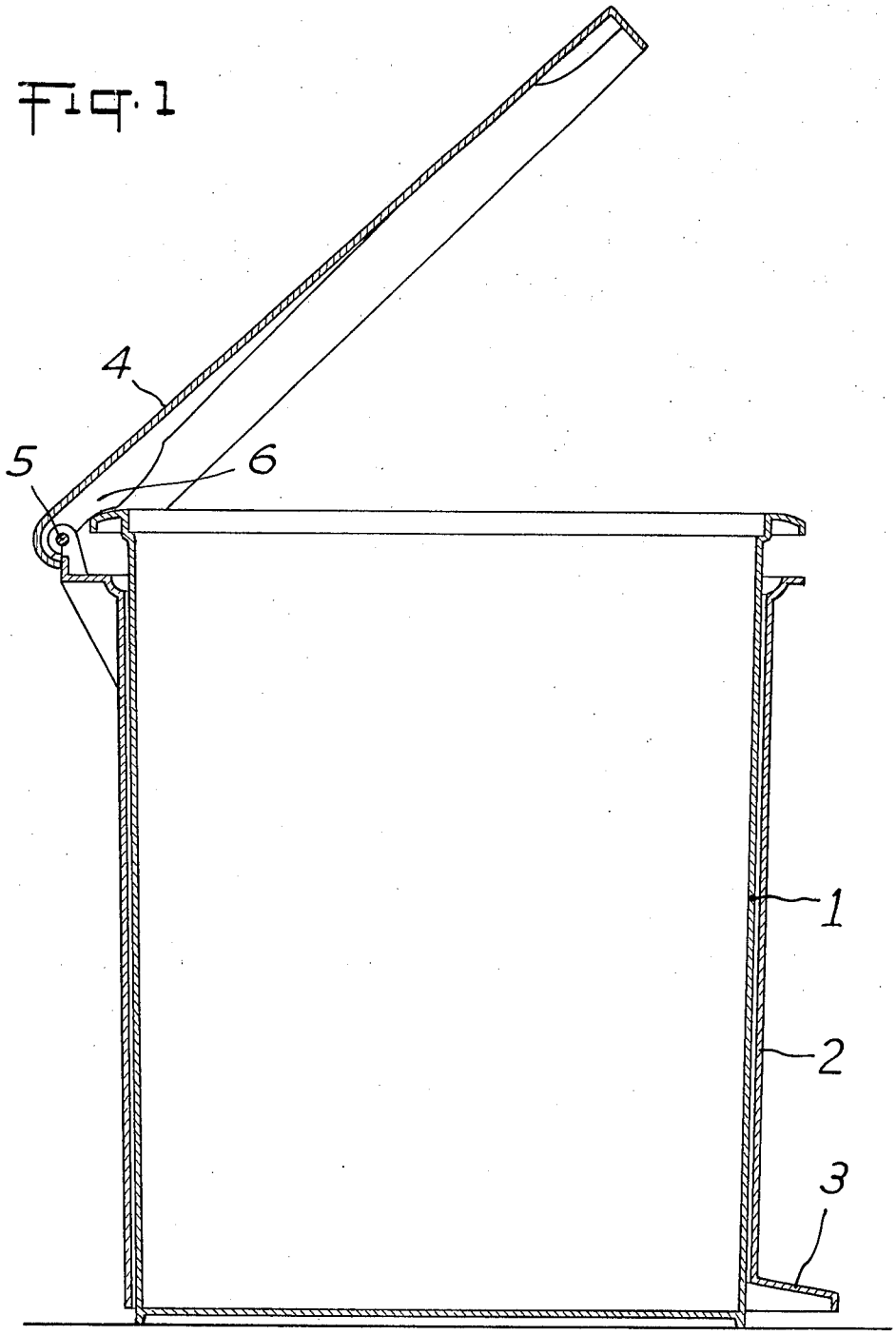
FIG. 1 shows a section through an embodiment of the bin according to the invention, in open position.
Figure 2:
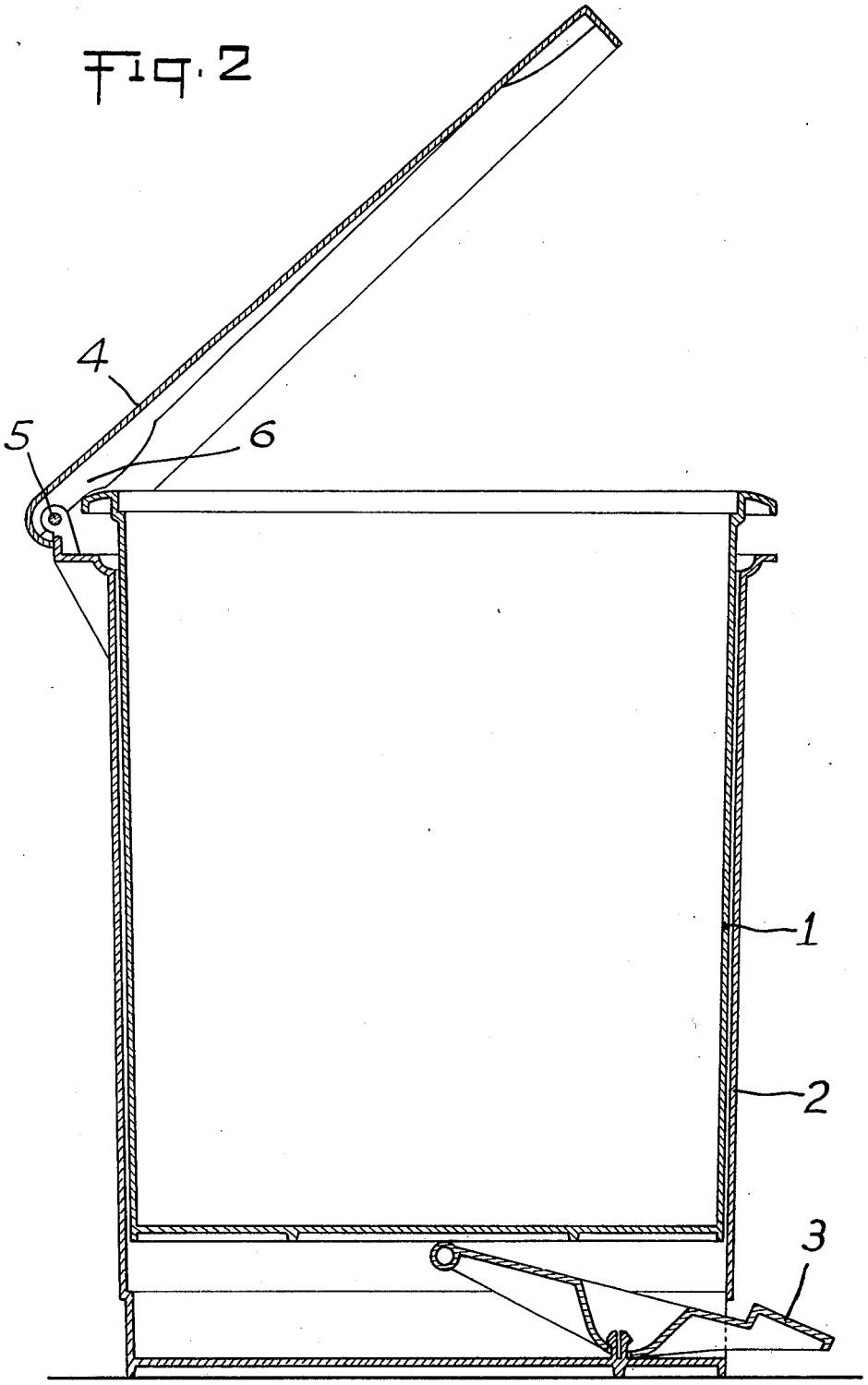
FIG. 2 shows a section through another embodiment of the bin, likewise in open position.

Referring now to the drawings, FIGS. 1 and 2 show a receptacle 1 forming the actual bin, and a jacket 2 adapted to slide along this receptacle, outside said receptacle. Said jacket may be solid or perforated or even constituted by two cylindrical portions. The relative movement of the jacket with respect to the receptacle is controlled by a pedal 3. In the embodiment of FIG. 1, the pedal is integral with the jacket and, when depressed, serves to lower said jacket whilst the receptacle remains fixed. In the embodiment of FIG. 2, the pedal is mounted as a rocking system, and, when depressed, pushes the receptacle upwards whilst the jacket remains fixed.

A lid 4 is adapted to cover the whole bin, and is connected to the jacket by a hinge 5.

It is immediately apparent that, by relative movement of the receptacle and the jacket (said movement provoked by depression of the pedal), the rib 6 of the lid, abuttng on the upper edge of the receptacle, causes said lid to open. When the pedal is no longer actuated, the weight of the lid is generally sufficient to cause it to close spontaneously. When this is not the case, it is possible to provide suitable means for returning said lid in closed position.

The invention produces a very convenient, simple pedal bin which may be made entirely of plastics material.

What we claim is:

1. A novel pedal bin, comprising:

a receptacle forming the actual bin;

base means associated with a lower portion of said receptacle for supporting said pedal bin relative to an underlying surface;

a jacket external of said receptacle and adapted to slide along the receptacle, relative movement of said jacket with respect to the receptacle being controlled by a pedal, said pedal being in force transmitting relationship with said jacket for lowering said jacket relative to said receptacle when said pedal is depressed, and a lid hinged to said jacket.

2. The pedal bin of claim 1, comprising:

means associated with said lid for opening said lid as said jacket is lowered by depressing said pedal; and means for returning said lid into closed position as said pedal is released and said jacket is raised.

* * * * *